US009813831B1

(12) United States Patent
Thomsen

(10) Patent No.: US 9,813,831 B1
(45) Date of Patent: Nov. 7, 2017

(54) MICROELECTROMECHANICAL SYSTEMS MICROPHONE WITH ELECTROSTATIC FORCE FEEDBACK TO MEASURE SOUND PRESSURE

(71) Applicant: Cirrus Logic International Semiconductor Ltd., Edinburgh (GB)

(72) Inventor: Axel Thomsen, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/363,863

(22) Filed: Nov. 29, 2016

(51) Int. Cl.
*H04R 29/00* (2006.01)
*H04R 19/04* (2006.01)
*H04R 19/00* (2006.01)

(52) U.S. Cl.
CPC ..... *H04R 29/004* (2013.01); *H04R 19/005* (2013.01); *H04R 19/04* (2013.01); *H04R 2201/003* (2013.01)

(58) Field of Classification Search
CPC ..... H04N 1/506; H04N 3/34; H04R 19/00; H04R 19/02; H04R 1/26; H04R 1/406; H04R 2430/20; H04R 3/005; H04R 1/005; H04R 23/00; H04S 2400/11; H03M 1/00; H03M 1/22; H04B 14/044
USPC ..... 381/92, 56–58, 122, 190, 91, 98, 174, 381/172
See application file for complete search history.

(56) References Cited

U.S. PATENT DOCUMENTS 8,363,860 B2 * 1/2013 Zhang ..... H04R 1/222 381/175
8,755,541 B2 * 6/2014 Liu ..... H04R 19/005 381/174

(Continued)

FOREIGN PATENT DOCUMENTS

GB 2467777 A 8/2010
JP 2004328076 A 11/2004
WO 2012020601 A1 2/2012

OTHER PUBLICATIONS

Search Report under Section 17, Application No. GB1700372.4, dated Feb. 23, 2017.

(Continued)

*Primary Examiner* — Lun-See Lao
(74) *Attorney, Agent, or Firm* — Jackson Walker L.L.P.

(57) ABSTRACT

A MEMS may include a backplate comprising first and second electrodes electrically isolated from one another and mechanically coupled to the backplate in a fixed relationship relative to the backplate, and a diaphragm configured to mechanically displace relative to the backplate as a function of sound pressure incident upon the diaphragm. The diaphragm may comprise third and fourth electrodes electrically isolated from one another and mechanically coupled to the diaphragm in a fixed relationship relative to the diaphragm such that the third and fourth electrodes mechanically displace relative to the backplate as the function of the sound pressure. The first and third electrodes may form a first capacitor, the second and fourth electrodes may form a second capacitor, and the first capacitor may be configured (Continued)

to sense a displacement of the diaphragm responsive to which the second capacitor may be configured to apply an electrostatic force to the diaphragm to return the diaphragm to an original position.

10 Claims, 3 Drawing Sheets

(56) References Cited

U.S. PATENT DOCUMENTS

| | | | | |
|---|---|---|---|---|
| 8,847,289 | B2 * | 9/2014 | Wang | B81C 1/00246 257/254 |
| 8,934,649 | B1 * | 1/2015 | Lee | H04R 19/005 381/174 |
| 2002/0093038 | A1 | 7/2002 | Ikeda et al. | |
| 2008/0170742 | A1 | 7/2008 | Trusov et al. | |
| 2009/0095081 | A1 | 4/2009 | Nakatani | |
| 2013/0241345 | A1 | 9/2013 | Takezaki et al. | |
| 2015/0002982 | A1 | 1/2015 | Cazzaniga et al. | |
| 2015/0163594 | A1 | 6/2015 | Andersen | |
| 2015/0318829 | A1 | 11/2015 | Astgimath | |
| 2016/0347605 | A1 * | 12/2016 | Thompson | B81B 3/0086 |

OTHER PUBLICATIONS

Search Report under Section 17, Application No. GB1700376.5, dated Feb. 24, 2017.

* cited by examiner

MICROELECTROMECHANICAL SYSTEMS MICROPHONE WITH ELECTROSTATIC FORCE FEEDBACK TO MEASURE SOUND PRESSURE

RELATED APPLICATIONS

The present disclosure is related to U.S. Provisional Patent Application Ser. No. 62/438,144, filed Dec. 22, 2016, which is incorporated by reference herein in its entirety.

FIELD OF DISCLOSURE

The present disclosure relates in general to audio systems, and more particularly, to improving the performance of microelectromechanical systems (MEMS) based transducers as compared to traditional approaches.

BACKGROUND

Microphones are ubiquitous on many devices used by individuals, including computers, tablets, smart phones, and many other consumer devices. Generally speaking, a microphone is an electroacoustic transducer that produces an electrical signal in response to deflection of a portion (e.g., a membrane or other structure) of a microphone caused by sound incident upon the microphone. For example, a microphone may be implemented as a MEMS transducer. A MEMS transducer may include a diaphragm or membrane having an electrical capacitance to a reference plane or backplate, such that a change in acoustic pressure applied to the MEMS transducer causes a deflection or other movement of the membrane, and thus causes a change in the electrical capacitance. Such electrical capacitance or the change thereof may be sensed by a sensing circuit and processed.

Existing MEMS microphone implementations are susceptible to various physical limitations that may affect accuracy of measurement of acoustic pressure on a microphone. For example, aging may affect performance of mechanical components of a MEMS microphone (e.g., displacement of a diaphragm as a function of acoustic pressure may change as a MEMS microphone ages). As another example, MEMS microphones may have non-linearities (e.g., displacement of a diaphragm as a function of acoustic pressure may not be linear), that are often complicated to correct for using traditional approaches.

SUMMARY

In accordance with the teachings of the present disclosure, certain disadvantages and problems associated with existing MEMS transducers may be reduced or eliminated.

In accordance with embodiments of the present disclosure, a microelectromechanical systems microphone may include a backplate and a diaphragm. The backplate may comprise a first plurality of electrodes comprising at least a first electrode and a second electrode electrically isolated from one another and each is mechanically coupled to the backplate in a fixed relationship relative to the backplate. The diaphragm may be configured to mechanically displace relative to the backplate as a function of sound pressure incident upon the diaphragm, wherein the diaphragm comprises a second plurality of electrodes, the second plurality of electrodes comprising at least a third electrode and a fourth electrode, wherein the third electrode and the fourth electrode are electrically isolated from one another and each is mechanically coupled to the diaphragm in a fixed relationship relative to the diaphragm such that the second plurality of electrodes mechanically displaces relative to the backplate as the function of sound pressure incident upon the diaphragm. The first electrode and the third electrode may form a first capacitor having a first capacitance, the second electrode and the fourth electrode may form a second capacitor having a second capacitance, and the first capacitor may be configured to sense a mechanical displacement of the diaphragm responsive to which the second capacitor may be configured to apply an electrostatic force to the diaphragm to return the diaphragm to an original position.

In accordance with these and other embodiments of the present disclosure, a method may include sensing a mechanical displacement of a diaphragm of a microelectromechanical systems microphone by a first capacitor. The diaphragm may be mechanically coupled to a backplate of the microelectromechanical systems microphone, the backplate comprising a first plurality of electrodes comprising at least a first electrode and a second electrode electrically isolated from one another and each is mechanically coupled to the backplate in a fixed relationship relative to the backplate and the diaphragm is configured to mechanically displace relative to the backplate as a function of sound pressure incident upon the diaphragm, wherein the diaphragm comprises a second plurality of electrodes, the second plurality of electrodes comprising at least a third electrode and a fourth electrode, wherein the third electrode and the fourth electrode are electrically isolated from one another and each is mechanically coupled to the diaphragm in a fixed relationship relative to the diaphragm such that the second plurality of electrodes mechanically displaces relative to the backplate as the function of sound pressure incident upon the diaphragm. The first electrode and the third electrode may form the first capacitor having a first capacitance and the second electrode and the fourth electrode may form a second capacitor having a second capacitance. The method may further include responsive to the mechanical displacement, applying an electrostatic force to the diaphragm via the second capacitor to return the diaphragm to an original position.

Technical advantages of the present disclosure may be readily apparent to one having ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are explanatory examples and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
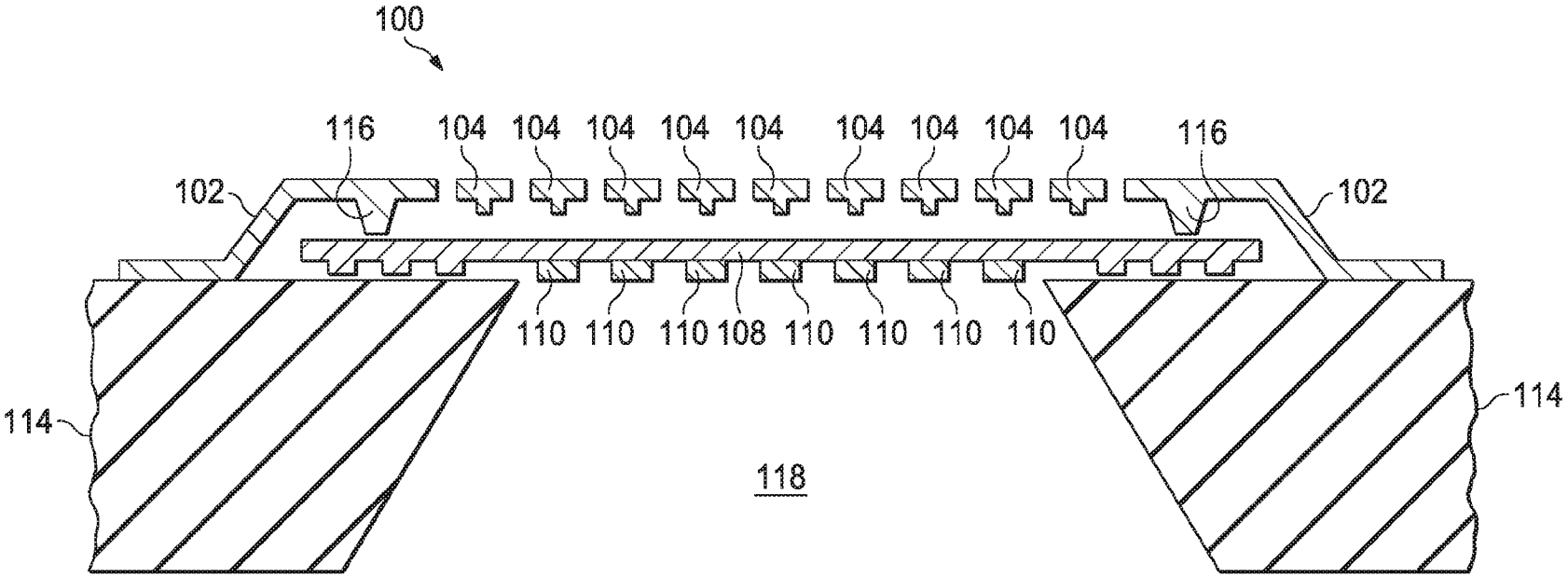
FIG. 1 illustrates a block diagram of selected components of an example MEMS microphone, in accordance with embodiments of the present disclosure.

FIG. 1 illustrates a block diagram of selected components of an example MEMS microphone 100, in accordance with embodiments of the present disclosure. As shown in FIG. 1, MEMS microphone 100 may comprise a backplate 102, a diaphragm 108, and a substrate 114.

Backplate 102 may include a plurality of electrodes 104 electrically isolated from one another and each mechanically coupled to backplate 102 in a fixed relationship relative to backplate 102. For the purposes of clarity and exposition, a particular number of electrodes are depicted in FIG. 1. However, backplate 102 may include any suitable number of electrodes.

Diaphragm 108 may comprise a membrane or other structure configured to mechanically displace relative to the backplate as a function of sound pressure incident upon diaphragm (e.g., through acoustic port 118 of substrate 114). As shown in FIG. 1, backplate 102 may be mechanically coupled to diaphragm 108 via a plurality of support posts 116 of backplate 102. Diaphragm 108 may include a plurality of electrodes 110 which are electrically isolated from one another and wherein each is mechanically coupled to diaphragm 108 in a fixed relationship relative to diaphragm 108 such that electrodes 110 mechanically displace relative to backplate 102 as the function of sound pressure incident upon diaphragm 108.

Substrate 114 may comprise any suitable substrate or surface (e.g., a semiconductor substrate) upon which MEMS microphone 100 may be fabricated. The various components of MEMS microphone 100 (e.g., backplate 102, electrodes 104, diaphragm 108, electrodes 110, support posts 116, etc.) may be formed on a substrate using semiconductor fabrication techniques now known or semiconductor fabrication techniques that may be known in the future. As also shown in FIG. 1, substrate 114 may also have an acoustic port 118 formed therein (e.g., using semiconductor fabrication techniques now known or semiconductor fabrication techniques that may be known in the future) through which sound pressure may propagate to diaphragm 108 to displace diaphragm 108 as a function of such sound pressure.

MEMS microphone 100 may be constructed such that each electrode 104 electrically interacts with a respective opposing electrode 110 so as to form a first capacitor having a capacitance which is a function of a displacement of diaphragm 108 relative to backplate 102.

The implementation shown in FIG. 1 may be one of many ways to construct a MEMS microphone in accordance with the present disclosure. Accordingly, one or more other implementations may exist for a MEMS microphone which are substantially equivalent to that of MEMS microphone 100 depicted in FIG. 1.

Figure 2:
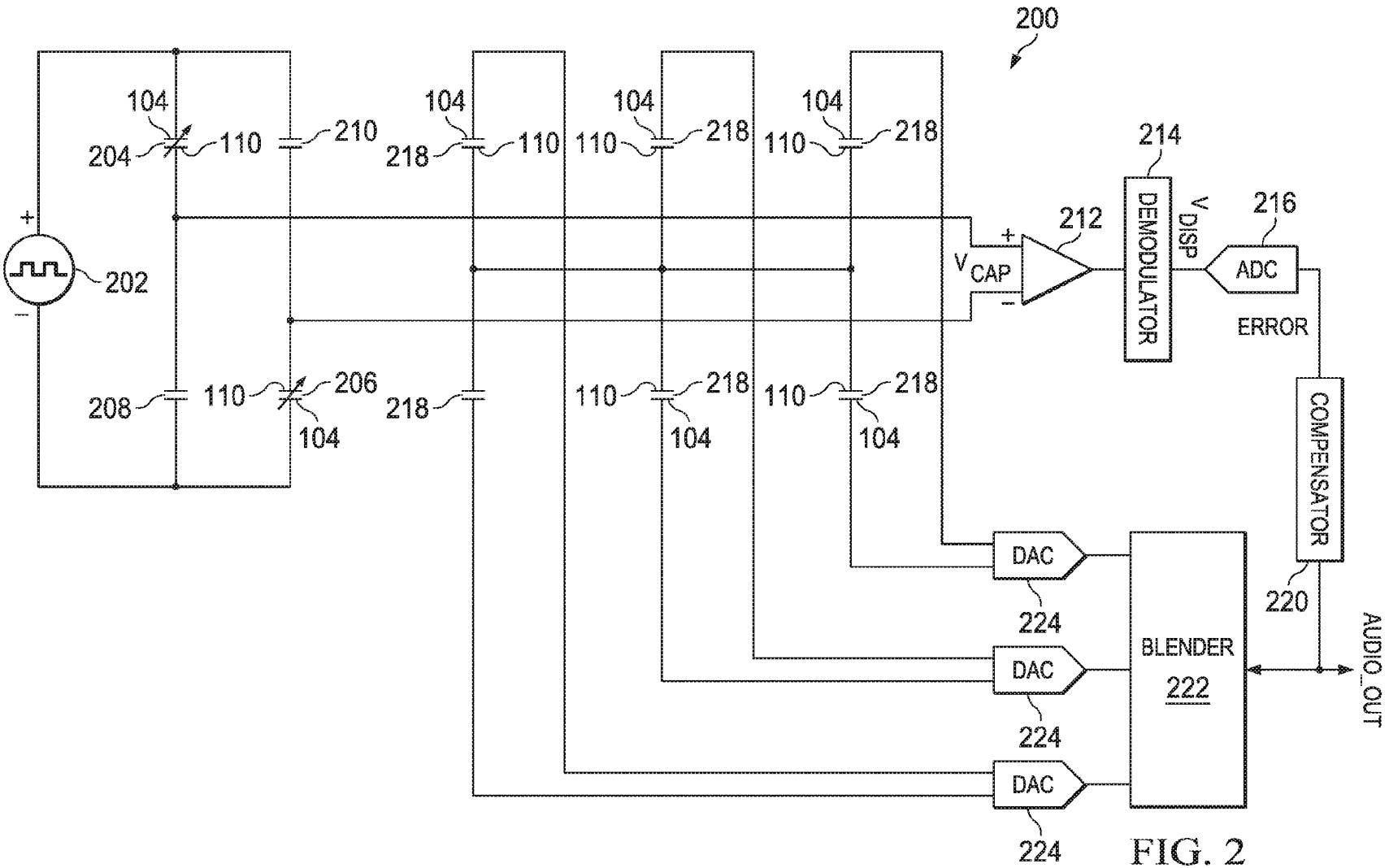
FIG. 2 illustrates a block diagram of selected components of an example audio system comprising a MEMS microphone having digital-based electrostatic force feedback, in accordance with embodiments of the present disclosure.

FIG. 2 illustrates a block diagram of selected components of an example audio system 200 comprising a MEMS microphone having digital-based electrostatic force feedback, in accordance with embodiments of the present disclosure. As shown in FIG. 2, audio system 200 may comprise a voltage supply 202, first capacitor 204 formed from an electrode 104 and an electrode 110, second capacitor 206 formed from an electrode 104 and an electrode 110, a third capacitor 208, a fourth capacitor 210, an amplifier 212, a demodulator 214, an analog-to-digital converter (ADC) 216, a plurality of electrostatic force compensation capacitors 218, a compensator 220, a blender 222, and one or more digital-to-analog converters (DACs) 224.

Voltage supply 202 may comprise any suitable system, device, or apparatus configured to output an alternating-current (AC) bias voltage $V_{BIAS}$ for biasing first capacitor 204 and second capacitor 206, as described in greater detail below. In some embodiments, voltage supply 202 may generate AC bias voltage $V_{BIAS}$ as a square-wave voltage waveform. However, any suitable AC waveform may be used. Voltage supply 202 may be implemented in any suitable manner, including without limitation with a charge pump power supply. In some embodiments, AC bias voltage $V_{BIAS}$ may have a frequency greater than that of human hearing (e.g., greater than 20 kilohertz).

As shown in FIG. 2, first electrode 104 of first capacitor 204 may be electrically coupled to a first terminal of voltage supply 202 and second electrode 104 of second capacitor 206 may be electrically coupled to a second terminal of voltage supply 202. Accordingly, each of first capacitor 204 and second capacitor 206 may be biased by the alternating-current voltage waveform generated by voltage supply 202. Furthermore, as shown in FIG. 2, first capacitor 204 and second capacitor 206 may be electrically coupled to one another in a bridge structure, the bridge structure comprising third capacitor 208 in series with first capacitor 204 and coupled between first capacitor 204 and the second terminal of voltage supply 202 and fourth capacitor 210 in series with second capacitor 206 and coupled between second capacitor 206 and the first terminal of voltage supply 202.

In operation, a differential signal $V_{CAP}$ comprising the difference in potential between a third electrode 110 (e.g. of first capacitor 204) and fourth electrode 110 (e.g., of second capacitor 206) may be generated due to the presence of AC bias voltage $V_{BIAS}$ and sound pressure incident on diaphragm 108 which displaces diaphragm 108 and induces changes in capacitances of first capacitor 204 and second capacitor 206. Thus, differential signal $V_{CAP}$ may comprise a signal which is a function of the displacement on diaphragm 108, wherein such signal is modulated at a frequency of AC bias voltage $V_{BIAS}$.

Amplifier 212 may comprise any suitable system, device, or apparatus configured to amplify an analog signal received at its input (e.g., differential signal $V_{CAP}$) to an amplified version of the input analog signal which may be more suitable for downstream processing.

Demodulator 214 may comprise any suitable system, device, or apparatus configured to extract from an analog signal (e.g., differential signal $V_{CAP}$ as amplified by amplifier 212) an information-bearing signal (e.g., analog displacement signal $V_{DISP}$) from a modulated carrier wave (e.g., a modulated carrier wave at the frequency of AC bias voltage $V_{BIAS}$). In some embodiments, demodulator 214 may comprise a synchronous modulator.

ADC 216 may comprise any suitable system, device, or apparatus configured to convert an analog signal (e.g., analog displacement signal $V_{DISP}$) into a corresponding digital signal (e.g., digital error signal ERROR). As described in greater detail below, digital signal ERROR may be an error signal of a closed feedback loop used to determine voltages to be driven on one or more of electrostatic force compensation capacitors 218 in order to create an electrostatic force on diaphragm 108 to force diaphragm 108 to an original position (e.g., a position diaphragm 108 would maintain in the absence of acoustic pressure incident upon it).

Each electrostatic force compensation capacitor 218 may be formed from an electrode 104 and an electrode 110. Each electrostatic force compensation capacitor 218 may be coupled via one of its electrodes 104, 110 to a ground voltage and coupled via the other one of its electrodes 104, 110 to one of the differential outputs of a DAC 224.

Compensator 220 may comprise any suitable system, device, or apparatus configured to receive digital error signal ERROR and based thereon, generate an audio output signal AUDIO_OUT (e.g., by integrating digital error signal ERROR). Audio output signal AUDIO_OUT generated by compensator 220 may be indicative of one or more voltages required to be driven on one or more of electrostatic force compensation capacitors 218 in order to create one or more electrostatic forces on diaphragm 108 to force diaphragm 108 to an original position (e.g., a position diaphragm 108 would maintain in the absence of acoustic pressure incident upon it). Accordingly, audio output signal AUDIO_OUT generated by compensator 220 may also be indicative of acoustic pressure incident on diaphragm 108. In some embodiments, compensator 220 may be implemented by a proportional-integral-derivative (PID) controller.

Blender 222 may receive audio output signal AUDIO_OUT and based thereon, determine what proportion of the voltage indicated by audio output signal AUDIO_OUT should be driven on each of the various individual electrostatic force compensation capacitors 218. For example, particular ones of electrostatic force compensation capacitors 218 and the respective DAC 224 driving such electrostatic force compensation capacitors 218 may be better adapted for receiving larger voltage signals while particular ones of electrostatic force compensation capacitors 218 and the respective DAC 224 driving such electrostatic force compensation capacitors 218 may be better adapted for receiving smaller voltage signals, in order to maximize a dynamic range of MEMS microphone 100 and audio system 200. In some instances, blender 222 may communicate an output signal to a single DAC 224. In other instances, blender 222 may communicate output signals to two or more DACs 224

A DAC 224 may comprise any suitable system, device, or apparatus configured to convert a digital signal (e.g., an output signal from blender 222) into a corresponding analog differential voltage and drive that differential voltage across a pair of electrostatic force compensation capacitors 218 coupled in series with one another (and which may each be coupled to a ground voltage at such series connection). Such differential voltage may induce an electrostatic force to the electrostatic force compensation capacitors 218 to offset an acoustically-induced force upon diaphragm 108, thus returning diaphragm 108 to an original position (e.g., a position diaphragm 108 would maintain in the absence of acoustic pressure incident upon it).

Accordingly, in audio system 200, one or more capacitors (e.g., capacitors 204 and 206) may sense a mechanical displacement of diaphragm 108 responsive to acoustic pressure. Responsive to such mechanical displacement, one or more other capacitors (e.g., electrostatic force compensation capacitors 218) may apply an electrostatic force to diaphragm 108 to return diaphragm 108 to an original position (e.g., a position diaphragm 108 would maintain in the absence of acoustic pressure incident upon it). In addition, the electrostatic force may be induced by at least one differential-mode voltage (e.g., generated by a DAC 224 based on the acoustically-induced mechanical displacement) of which at least a portion is applied to an electrostatic force compensation capacitor 218, and wherein such differential-mode voltage is indicative of acoustic pressure incident upon the diaphragm. In some instances, multiple DACs 224 may drive multiple capacitors (e.g., electrostatic force compensation capacitors 218) such that the combined electrostatic forces contributed by all electrostatic force compensation capacitors 218 balance the acoustically-induced forces upon diaphragm 108 to return diaphragm 108 to its original position.

In addition, although not explicitly shown in FIG. 2 for the purposes of clarity and exposition, in some embodiments, one or more of electrostatic force compensation capacitors 218 may be programmable between being used in a capacitor for sensing mechanical displacement and being used as an electrode in a capacitor for applying electrostatic force to diaphragm 108 to return diaphragm 108 to its original position. Accordingly, in such embodiments, audio system 200 may include a plurality of switches and controls for such switches such that one or more electrostatic force compensation capacitors 218 may be programmed in such manner.

Furthermore, although FIG. 2 depicts a particular coupling of electrostatic force compensation capacitors 218 to the differential outputs of DACs 224 (e.g., each electrostatic force compensation capacitor 218 in FIG. 2 is shown as being coupled via an electrode 104 of backplate 102), in some embodiments, one or more electrostatic force compensation capacitors 218 may be coupled to a differential output of a DAC 224 via its electrode 110 of diaphragm 108. In addition, although FIG. 2 shows each DAC 224 coupled to an electrostatic force compensation capacitor 218 at each of its differential outputs, in some embodiments only one differential output of a DAC 224 may be coupled to an electrostatic force compensation capacitor 218 while its other differential output is coupled to a capacitor formed from electrodes other than electrodes 104 and 110 (e.g., a fixed capacitor) in lieu of another electrostatic force compensation capacitor 218.

Figure 3:
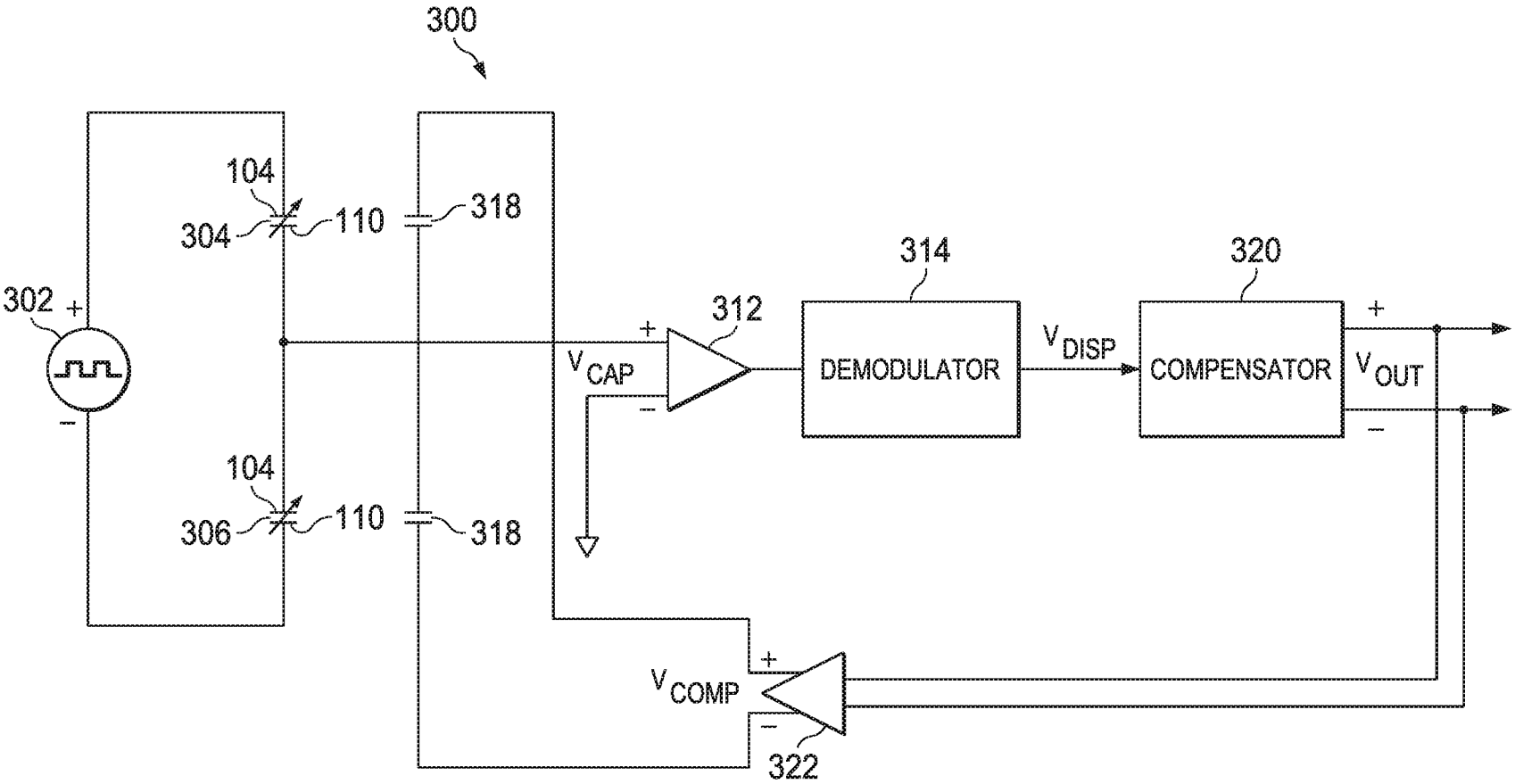
FIG. 3 illustrates a block diagram of selected components of an example audio system comprising a MEMS microphone having analog-based electrostatic force feedback, in accordance with embodiments of the present disclosure.

FIG. 3 illustrates a block diagram of selected components of an example audio system 300 comprising a MEMS microphone having analog-based electrostatic force feedback, in accordance with embodiments of the present disclosure. In many respects, example audio system 300 may be the analog equivalent of example audio system 200, so only the main differences between example audio system 300 and example audio system 200 may be discussed herein. As shown in FIG. 3, audio system 300 may comprise a voltage supply 302, first capacitor 304 formed from an electrode 104 and an electrode 110, second capacitor 306 formed from an electrode 104 and an electrode 110, an amplifier 312, a demodulator 314, a plurality of electrostatic force compensation capacitors 318, a compensator 320, and an amplifier 322.

Voltage supply 302 may comprise any suitable system, device, or apparatus configured to output an alternating-current (AC) bias voltage $V_{BIAS}$ for biasing first capacitor 304 and second capacitor 306, as described in greater detail below. In some embodiments, voltage supply 302 may generate AC bias voltage $V_{BIAS}$ as a square-wave voltage waveform. However, any suitable AC waveform may be used. Voltage supply 302 may be implemented in any suitable manner, including without limitation with a charge pump power supply. In some embodiments, AC bias voltage $V_{BIAS}$ may have a frequency greater than that of human hearing (e.g., greater than 20 kilohertz).

As shown in FIG. 3, first electrode 104 of first capacitor 304 may be electrically coupled to a first terminal of voltage supply 302 and second electrode 104 of second capacitor 306 may be electrically coupled to a second terminal of voltage supply 302. Accordingly, each of first capacitor 304 and second capacitor 306 may be biased by the alternating-current voltage waveform generated by voltage supply 302. In operation, a single-ended signal $V_{CAP}$ may be generated due to the presence of AC bias voltage $V_{BIAS}$ and sound pressure incident on diaphragm 108 which displaces diaphragm 108 and induces changes in capacitances of first capacitor 304 and second capacitor 306. Thus, differential signal $V_{CAP}$ may comprise a signal which is a function of the displacement on diaphragm 108, wherein such signal is modulated at a frequency of AC bias voltage $V_{BIAS}$.

Amplifier 312 may comprise any suitable system, device, or apparatus configured to amplify an analog signal received at its input (e.g., signal $V_{CAP}$) to an amplified version of the input analog signal which may be more suitable for downstream processing.

Demodulator 314 may comprise any suitable system, device, or apparatus configured to extract from an analog signal (e.g., differential signal $V_{CAP}$ as amplified by amplifier 312) an information-bearing signal (e.g., analog displacement signal $V_{DISP}$) from a modulated carrier wave (e.g., a modulated carrier wave at the frequency of AC bias voltage $V_{BIAS}$. In some embodiments, demodulator 314 may comprise a synchronous modulator.

Each electrostatic force compensation capacitor 318 may be formed from an electrode 104 and an electrode 110. Each electrostatic force compensation capacitor 318 may be coupled via one of its electrodes 104, 110 to a ground voltage and coupled via the other one of its electrodes 104, 110 to one of the differential outputs of amplifier 322.

Compensator 320 may comprise any suitable system, device, or apparatus configured to receive analog displacement signal $V_{DISP}$ and based thereon, generate an audio output signal $V_{OUT}$ (e.g., by integrating analog displacement signal $V_{DISP}$). Audio output signal $V_{OUT}$ generated by compensator 320 may be indicative of one or more voltages required to be driven on one or more of electrostatic force compensation capacitors 318 in order to create one or more electrostatic forces on diaphragm 108 to force diaphragm 108 to an original position (e.g., a position diaphragm 108 would maintain in the absence of acoustic pressure incident upon it). Accordingly, audio output signal $V_{OUT}$ generated by compensator 320 may also be indicative of acoustic pressure incident on diaphragm 108. In some embodiments, compensator 320 may be implemented by a proportional-integral-derivative (PID) controller.

Amplifier 322 may comprise any suitable system, device, or apparatus configured to amplify an analog signal received at its input (e.g., audio output signal $V_{OUT}$) to an amplified version of the input analog signal (e.g., a differential compensation signal $V_{COMP}$) which may be more suitable for downstream processing. Such differential compensation signal $V_{COMP}$ may induce an electrostatic force to electrostatic force compensation capacitors 318 to offset an acoustically-induced force upon diaphragm 108, thus returning diaphragm to an original position (e.g., a position diaphragm 108 would maintain in the absence of acoustic pressure incident upon it).

Accordingly, in audio system 300, one or more capacitors (e.g., capacitors 304 and 306) may sense a mechanical displacement of diaphragm 108 responsive to acoustic pressure. Responsive to such mechanical displacement, one or more other capacitors (e.g., electrostatic force compensation capacitors 318) may apply an electrostatic force to diaphragm 108 to return diaphragm 108 to an original position (e.g., a position diaphragm 108 would maintain in the absence of acoustic pressure incident upon it). In addition, the electrostatic force may be induced by at least one differential-mode voltage (e.g., generated by amplifier 322 based on the acoustically-induced mechanical displacement) of which at least a portion is applied to an electrostatic force compensation capacitor 318, and wherein such differential-mode voltage is indicative of acoustic pressure incident upon the diaphragm.

In addition, although FIG. 3 depicts a particular coupling of electrostatic force compensation capacitors 318 to the differential outputs of amplifier 322 (e.g., each electrostatic force compensation capacitor 318 in FIG. 3 is shown as being coupled via an electrode 104 of backplate 102), in some embodiments, one or more electrostatic force compensation capacitors 318 may be coupled to a differential output of amplifier 322 via its electrode 110 of diaphragm 108. Furthermore, although FIG. 3 shows amplifier 322 coupled to an electrostatic force compensation capacitor 318 at each of its differential outputs, in some embodiments only one differential output of amplifier 322 may be coupled to an electrostatic force compensation capacitor 318 while its other differential output is coupled to a capacitor formed from electrodes other than electrodes 104 and 110 (e.g., a fixed capacitor) in lieu of another electrostatic force compensation capacitor 318.

Advantageously, the systems and methods herein may provide an improvement over existing MEMS microphone implementations. For example, the systems and methods herein may provide for measurement of acoustic pressure without dependence on mechanical parameters of diaphragm 108 (e.g., nonlinearity, change in performance due to aging, etc.). As another example, the systems and methods herein may cancel out in-band resonance which might otherwise lead to measurement inaccuracy. As a further example, the systems and methods described herein may, compared with traditional implementations, improve the dynamic range of measurement of acoustic pressure, as sensing is not limited by the mechanical displacement limits of a MEMS microphone, but limited only by the range of differential output voltages applied to electrostatic force compensation capacitors (e.g., electrostatic force compensation capacitors 218 and 318).

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

What is claimed is:

1. A microelectromechanical systems microphone, comprising:

a backplate comprising a first plurality of electrodes comprising at least a first electrode and a second electrode electrically isolated from one another and each is mechanically coupled to the backplate in a fixed relationship relative to the backplate; and a diaphragm configured to mechanically displace relative to the backplate as a function of sound pressure incident upon the diaphragm, wherein the diaphragm comprises a second plurality of electrodes, the second plurality of electrodes comprising at least a third electrode and a fourth electrode, wherein the third electrode and the fourth electrode are electrically isolated from one another and each is mechanically coupled to the diaphragm in a fixed relationship relative to the diaphragm such that the second plurality of electrodes mechanically displaces relative to the backplate as the function of sound pressure incident upon the diaphragm;

wherein:

the first electrode and the third electrode form a first capacitor having a first capacitance;

the second electrode and the fourth electrode form a second capacitor having a second capacitance; and the first capacitor is configured to sense a mechanical displacement of the diaphragm responsive to which the second capacitor is configured to apply an electrostatic force to the diaphragm to return the diaphragm to an original position.

2. The microelectromechanical systems microphone of claim 1, wherein the electrostatic force is induced by a differential-mode voltage of which at least a portion is applied to the second capacitor, and wherein the differential-mode voltage is indicative of acoustic pressure incident upon the diaphragm.

3. The microelectromechanical systems microphone of claim 2, further comprising a digital-to-analog converter configured to generate the differential-mode voltage based on the mechanical displacement.

4. The microelectromechanical systems microphone of claim 3, wherein:

the first plurality of electrodes further comprises a fifth electrode;

the second plurality of electrodes further comprises a sixth electrode;

the fifth electrode and the sixth electrode form a third capacitor; and the microelectromechanical systems microphone further comprises a second digital-to-analog converter configured to generate a second differential-mode voltage based on the mechanical displacement to induce a second electrostatic force applied by the third capacitor to the diaphragm, that combined with the electrostatic force, returns the diaphragm to the original position.

5. The microelectromechanical systems microphone of claim 1, wherein at least one of the plurality of electrodes is programmable between being used as an electrode in a capacitor for sensing the mechanical displacement and being used as an electrode in a capacitor for applying electrostatic force to the diaphragm to return the diaphragm to the original position.

6. A method, comprising:

sensing a mechanical displacement of a diaphragm of a microelectromechanical systems microphone by a first capacitor, wherein:

the diaphragm is mechanically coupled to a backplate of the microelectromechanical systems microphone, the backplate comprising a first plurality of electrodes comprising at least a first electrode and a second electrode electrically isolated from one another and each is mechanically coupled to the backplate in a fixed relationship relative to the backplate; and the diaphragm is configured to mechanically displace relative to the backplate as a function of sound pressure incident upon the diaphragm, wherein the diaphragm comprises a second plurality of electrodes, the second plurality of electrodes comprising at least a third electrode and a fourth electrode, wherein the third electrode and the fourth electrode are electrically isolated from one another and each is mechanically coupled to the diaphragm in a fixed relationship relative to the diaphragm such that the second plurality of electrodes mechanically displaces relative to the backplate as the function of sound pressure incident upon the diaphragm;

the first electrode and the third electrode form the first capacitor having a first capacitance; and the second electrode and the fourth electrode form a second capacitor having a second capacitance; and responsive to the mechanical displacement, applying an electrostatic force to the diaphragm via the second capacitor to return the diaphragm to an original position.

7. The method of claim 6, further comprising inducing the electrostatic force by a differential-mode voltage of which at least a portion is applied to the second capacitor, and wherein the differential-mode voltage is indicative of acoustic pressure incident upon the diaphragm.

8. The method of claim 7, further comprising generating the differential-mode voltage by a digital-to-analog converter based on the mechanical displacement.

9. The method of claim 8, further comprising responsive to the mechanical displacement;

generating a second differential-mode voltage based on the mechanical displacement to induce a second electrostatic force on a third capacitor formed from a fifth electrode of the first plurality of electrodes and a sixth electrode of the second plurality of electrodes; and applying the second electrostatic force to the diaphragm, that combined with the electrostatic force, returns the diaphragm to the original position.

10. The method of claim 6, further comprising programming at least one of the plurality of electrodes between being used as an electrode in a capacitor for sensing the mechanical displacement and being used as an electrode in a capacitor for applying electrostatic force to the diaphragm to return the diaphragm to the original position.

* * * * *